United States Patent [19]

Zibrun

[11] 3,995,531

[45] Dec. 7, 1976

[54] STEAM ENGINE

[76] Inventor: Joseph Zibrun, 1741 W. 33rd St., Chicago, Ill. 60608

[22] Filed: Dec. 19, 1975

[21] Appl. No.: 642,360

[52] U.S. Cl. ..... 91/152; 91/416

[51] Int. Cl.[2] ..... F01B 1/00; F15B 15/17

[58] Field of Search ..... 91/152, 8, 416

[56] References Cited

UNITED STATES PATENTS

| | | | |
|---|---|---|---|
| 459,507 | 9/1891 | Eickershoff | 91/152 |
| 573,216 | 12/1896 | Halvorsen | 91/152 |
| 662,417 | 11/1900 | Grant | 91/152 |
| 1,543,431 | 6/1925 | Freiberg | 91/152 |

*Primary Examiner*—Paul E. Maslousky
*Attorney, Agent, or Firm*—Van Metre Lund; John C. Brezina

[57] ABSTRACT

A steam engine is provided including a piston having an upper end portion movable upwardly and downwardly within an internal cylindrical surface of a cylinder, toward and away from a top wall to define a first variable volume space while moving away from and toward annular means in sealing engagement with a lower reduced diameter portion of the piston to define a second variable volume space. A connecting rod has an upper end pivotally connected to the piston and a lower end pivotally connected to a crankshaft. A valve assembly is provided for flow of high pressure steam to the second space and for flow from the first space to an outlet during upward movement of the piston and for flow of steam from the second space to the first space during downward movement of the piston. Preferably, the piston has a lower end portion sealingly engaged with a second internal cylindrical surface of the cylinder to define a third space which is connected through breather passages to the exhaust outlet. Important features relate to the construction of the cylinder and piston to facilitate assembly and to the construction of the valve assembly to obtain highly efficient and reliable operation.

11 Claims, 2 Drawing Figures

STEAM ENGINE

This invention relates to a steam engine and more particularly to a steam engine which is comparatively simple in construction and operation while being highly efficient. The engine is readily and economically manufacturable and is compact so as to occupy a minimum space while developing a high and uniform output torque, being especially adapted for use in automotive vehicles.

BACKGROUND OF THE INVENTION

In my U.S. Pat. No. 3,759,141, issued Sept. 18, 1973, I disclose a steam engine which has a number of highly desirable features including provisions for the double use of steam and including valve arrangements selectively operable to obtain double use of the steam with movement of the piston in both directions, as desired. The design as disclosed in my patent is, however, more complicated than would be desirable, especially for use in driving automobiles and other vehicles. It also is of relatively large size and is not as compact as would be desirable.

SUMMARY OF THE INVENTION

This invention was evolved with the general object of improving upon the construction of my prior patent, particularly with regard to providing a simplified design which is compact and readily and economically manufacturable, while being highly efficient and producing a smooth output torque.

In accordance with an important feature of the invention, an engine is provided in which a connecting rod is pivotally connected at its lower end to a crankshaft and at its upper end to a piston which has an upper end portion movable upwardly and downwardly within an internal cylindrical surface of cylinder means, toward and away from a top wall to define a first variable volume space. At the same time, the upper end portion moves away from and toward annular means which project inwardly into sealing engagement with a lower reduced diameter portion of the piston to define a second variable volume space. A valve assembly is provided for flow of high pressure steam to the second space and for flow from the first space to an exhaust steam outlet during upward movement of the piston and for flow of steam from the second space to the first space during downward movement of the piston. Because of the direct connection of the piston to the crankshaft through the connecting rod, the overall size of the engine is minimized and at the same time, the construction provides for the application of a positive driving force to the piston both when it is travelling up and when it is travelling down. The area against which the high pressure steam acts is substantially less than that against which the intermediate pressure steam acts and as a result, the forces acting on the piston in the up and down strokes are more nearly equalized and the torque applied to the crankshaft is more uniform. The requirements with respect to a flywheel are thus minimized.

In accordance with a specific feature, the piston has a lower end portion sealingly engaged with a second internal cylindrical surface of the cylinder means to define a third space and this third space is connected through breather passages to the exhaust outlet of the engine. This has a number of advantages including the fact that a much more effective seal is obtained, preventing loss of steam and preventing admixture of oi and steam. It is particularly desirable in permittin lubrication of the crankshaft and connecting rod bear ings in conventional fashion.

Additional important features of the invention relat to the construction of the valve assembly in a manne such that it operates freely without any binding actio and provides for steam flow with minimum loss of en ergy, to the provision of specially curved passageway for flow of steam to and from the variable volum spaces and to the construction of the piston means an other elements in a manner such that they can b readily assembled while providing a high degree o strength.

It is here noted that the preferred embodiment i hereinafter illustrated and described as being operabl with the piston movable in a vertical direction and wit the crankshaft below. This orientation, while preferred does not have to be used in all cases and it will there fore be understood that terms such as "vertical", "hori zontal", "upper" and "lower" are used only to facili tate description of the relative placement of parts an are not to be construed as limitations. Also, "steam" i intended to be used in a generic sense to include an type of pressurized fluid which might be used in a engine of the type disclosed.

This invention contemplates other objects, feature and advantages which will become more fully apparen from the following detailed description taken in con junction with the accompanying drawings.

DESCRIPTION OF A PREFERRED EMBODIMENT

Figures 1, 2, 3, 4, 5:
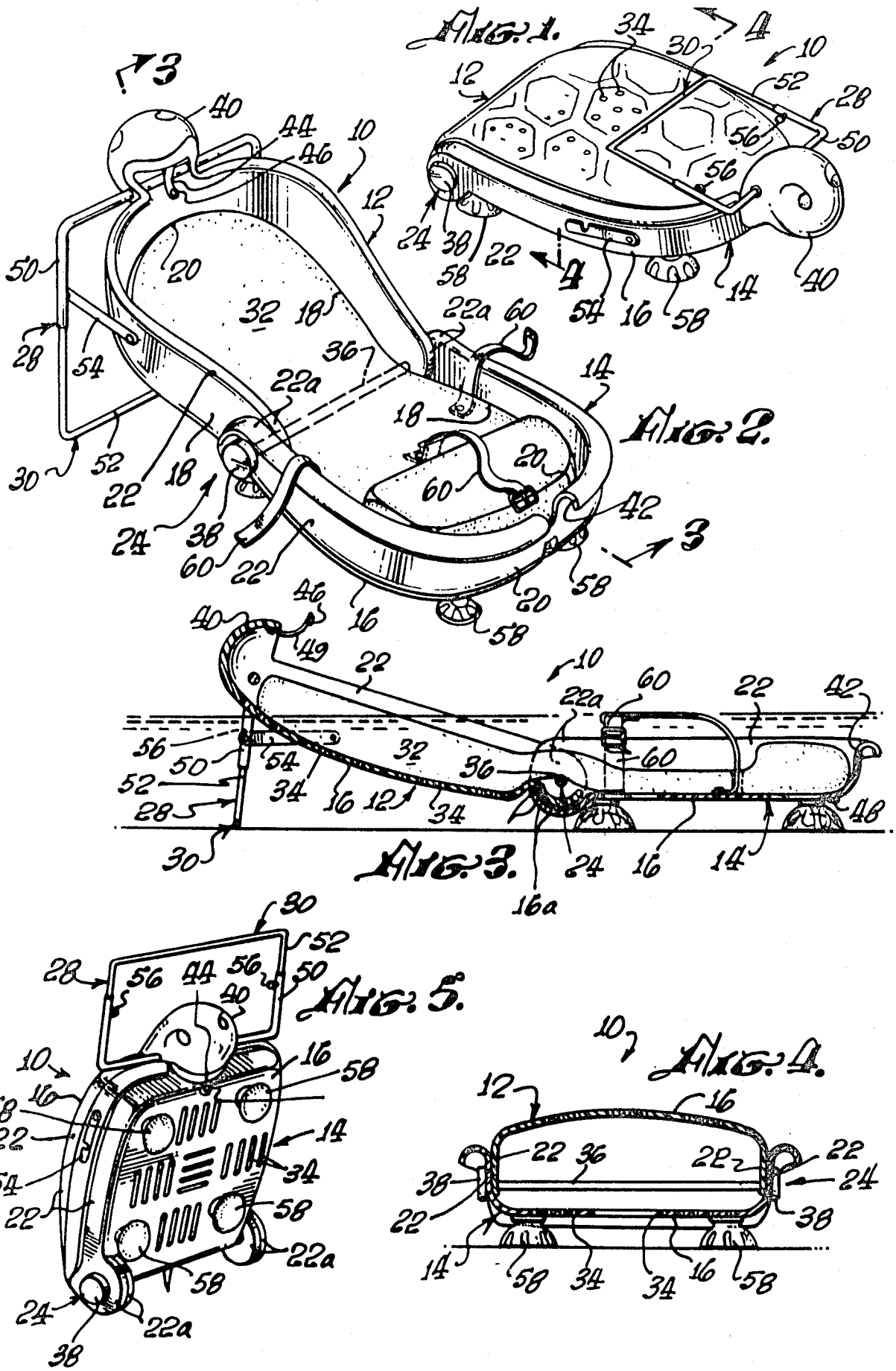
FIG. 1 is a vertical cross-sectional view of a stean engine constructed in accordance with the invention and FIG. 2 is a horizontal sectional view, looking up wardly and taken substantially along line II—II of FIG 1.
Figure 1:
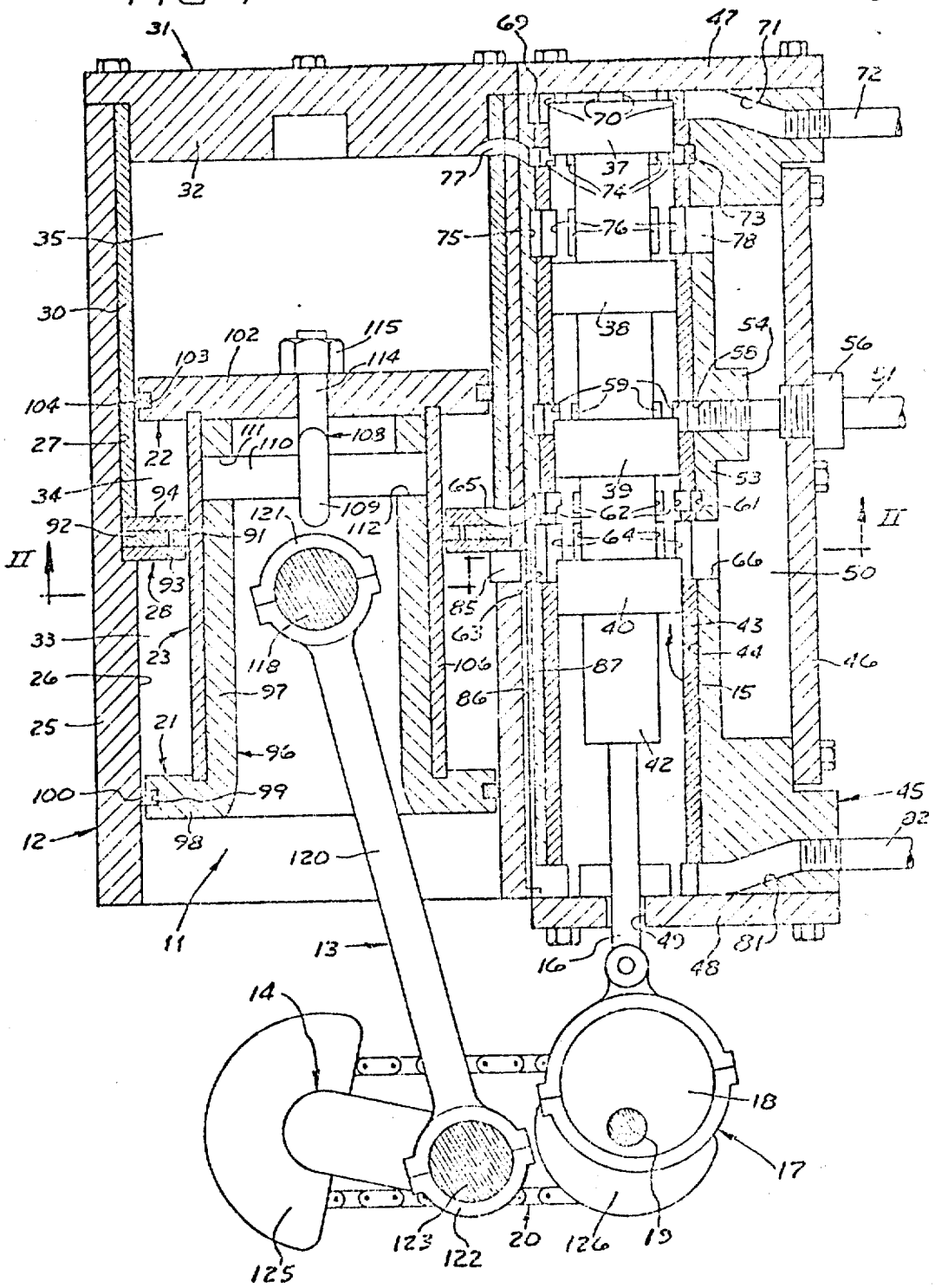
Figure 2:
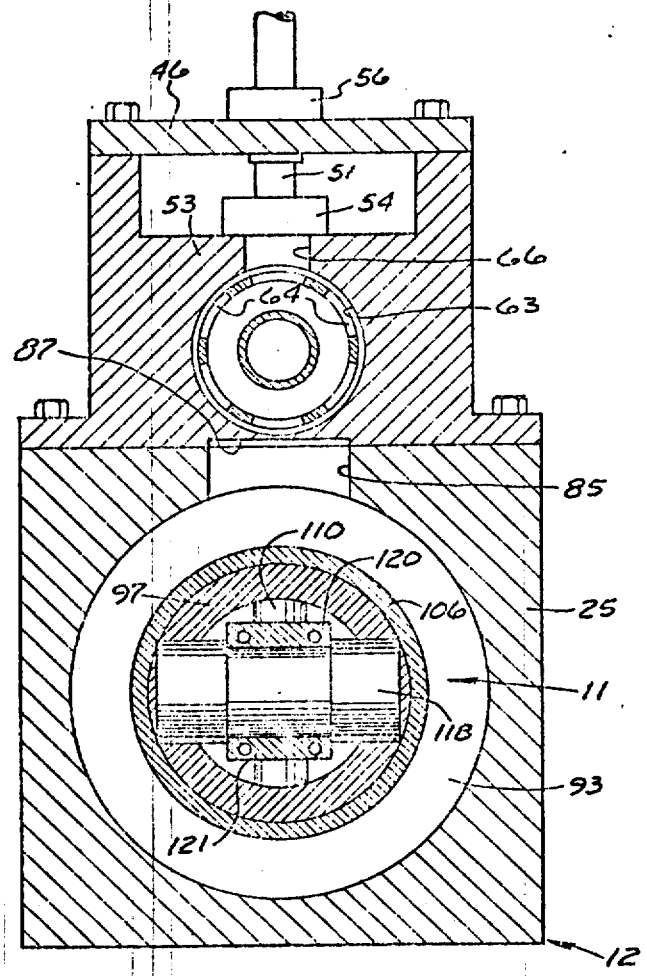

Reference numeral 10 generally designates a stean engine constructed in accordance with the principles o this invention. The engine 10 includes a piston gener ally designated by reference numeral 11 which is mov able within a cylinder structure generally designated b reference numeral 12. The piston 11 is directly con nected through a connecting rod 13 to a crankshaft 14 A reciprocable slide valve 15 is provided for control o the entrance and exit of steam and is connecte through a rod 16 to a ring 17 which is journalled on a eccentric 18 on a shaft 19, shaft 19 being coupled t the crankshaft 14 to be rotated therefrom, as through spocket chain 20 meshed with suitable sprocke wheels, not shown, on the shaft 19 and crankshaft 14

The piston 11 has opposite end portions generall indicated by reference numeral 21 and 22 and furthe includes an intermediate reduced diameter portion 2 between the opposite end portions 21 and 22. Th cylinder structure 12 includes a main body 25 havin an internal cylindrical surface portion 26 sealingly en gaged by the end portion of the piston 11. The body 2 additionally has an internal cylindrical surface 27 cor centric to and of larger diameter than the surface 2 with a separator structure generally indicated by refe ence numeral 28 being disposed against the annul shoulder between surfaces 26 and 27 and having a inside surface in sealing engagement with the reduce diameter portion 23 of the piston 11. A sleeve 30 provided having an outer surface engaged with the surface 27 and having an inner cylindrical surface sealingly engaged by the end portion 22 of the piston 11. One end of the sleeve 30 engages the separator structure 28 and the opposite end thereof is engaged by an end plate 31 secured to the main body 25 by suitable bolts. The end plate 31 may include an integral portion 32 extending inside the sleeve 30 and having a shape complementary to that of the end portion 22 of the piston 11.

With this arrangement, a first space 33 is provided between the separator structure 28 and the end portion 21 of the piston, a second space 34 is provided between the separator and structure 28 and the end portion 22 of the piston 11 and a third space 35 is provided between the end plate 31 and the end portion 22 of the piston 11, within the cylindrical inner surface of the sleeve 30.

The reciprocable valve 15 controls the flow of steam to and from the spaces 34 and 35. In brief, during downward movement of the piston 11 as viewed in FIG. 1, the crankshaft 14 being rotated in a clockwise direction, steam of intermediate pressure flows out of the space 34 and through the valve structure to the space 35 to apply pressure against the upper face of the upper end portion 21 of the piston 11, the chamber 34 being of reducing volume and the chamber 35 being of increasing volume during this described portion of the cycle. When the crankshaft 14 is rotated further in a clockwise direction, approximately a quarter-turn or more from the illustrated position, high pressure steam is admitted into the space 34 to act against the exposed lower face of the upper end portion 22 of the piston 11 and to apply force urging the piston upwardly. At the same time, steam is exhausted from the space 35. After the piston reaches the limit of its upward movement and again starts to move down, the pressure in the chamber 34, although less than the pressure of the inlet steam, is still substantial and when it is admitted into the space 35, it exerts a large force urging the piston downwardly, particularly considering the fact that the area of the upper face of the end portion 22 is much larger than the area of the exposed lower face of the end portion 22.

The space 33 is connected through "breather" passages to the exhaust. Any steam which may get past the seal between the separator structure 28 and the reduce-diameter portion 23 of the piston is expelled out of the space 33 into the exhaust during upward movement of the piston.

The valve 15 is in the form of a spool valve having four axially spaced annular portions 37, 38, 39 and 40 of equal diameter on a central axially extending member 42 of reduced diameter, member 42 being preferably in the form of a hollow tube. The valve 15 is disposed within a sleeve 43 inserted in a bore 44 of a valve body generally designated by reference numeral 45. One side of the body 45 is closed by a side plate 46 and the upper and lower ends of a body 45 are closed by top and bottom end plates 47 and 48, the end plate 48 having an opening 49 through which the rod 16 extends.

The valve body 45 is formed to provide a space 50 inside the side plate 46, forming a chamber and passageway for intermediate pressure steam, as hereinafter described.

For supply of high pressure steam, a pipe 51 extends through an opening in the side plate 46 and has an inner end threaded into a valve body wall portion 53, an upstanding spud portion 54 being provided on the wall 53 for receiving the inner end of the pipe 51 wirh an extended threaded connection. A suitable gland fitting 56 is threaded into the side plate 46 around the pipe 51. The inner end of the pipe 51 communicates with an annular groove 58 formed in the bore 44 of the valve body 45, the sleeve 43 having a plurality of angularly spaced openings 59 in axial alignment with the groove 58, and providing for flow of steam into the space between portions 38 and 39 of the valve 15.

Another annular groove 61 is provided in the bore 44 of the valve body 45 and is in axial alignment with a plurality of angularly spaced openings 62 in the sleeve 43. Another annular groove 63 is provided in axially spaced relation to the groove 61 and in axial alignment with a plurality of angularly spaced openings 64 in the sleeve 43. Groove 61 communicates with the space 34 through a specially curved passage 65 while groove 63 communicates with the space or chamber 50 through a passage 66 in the wall 53. In the position of the parts as illustrated in FIG. 1, steam flows out of the space 34 through the curved passage 65, thence into the annular groove 61 and through the openings or ports 62 into the space between valve portions 39 and 40. The steam then flows through the openings or ports 64 into the annular groove 63 and thence out through the opening 66 into the space 50.

For controlled flow to and from the space 35, additional grooves, ports and passages are provided. In particular, an annular groove 69 is provided in the upper end of the bore 44 in axial alignment with a plurality of angularly spaced ports 70 in the sleeve 43, the groove 69 communicating through a passage 71 with the end of an exhaust pipe 72 threaded into the valve body 45. Another annular groove 73 is provided in axial alignment with a plurality of angularly spaced ports 74 in the sleeve 43 and a groove 75 is provided in axial alignment with a plurality of angularly spaced ports 76 in the sleeve 43. The groove 73 communicates with the space 35 through a specially curved passage 77 while the groove 75 communicates with the chamber 50 through a passage 78 in the wall 53.

In the position of the valve member 15 as illustrated, steam flows from the chamber 50 through the passage 78 into the groove 75 and through the ports 76 into the space between valve portions 37 and 38. The steam then flows through the ports 74 into the groove 73 thence through the passage 77 into the space 35.

When the valve 15 is moved downwardly to a predetermined extent, it reaches a neutral position in which the upper side of the valve portion 37 is just above the port 74 while the lower side of the valve portion 39 is just below the ports 62. At this point, flow to and from the spaces 34 and 35 is blocked.

With additional movement of the valve member 15 in the downward direction, the upper side of the valve portion 37 initially moves below the upper side of the ports 74 to allow flow from the space 35 out through passage 77 to the groove 73, thence through ports 74 into the space above the valve portion 77, thence through ports 70 into the groove 69 and thence through the passage 71 to the exhaust pipe 72. Then with further movement in the downward direction, the upper side of the valve portion 39 moves below the upper sides of the ports 62 to allow flow of high pressure steam from the space between valve portions 38 and 39 through ports 62 into the groove 61 and thence through passage 65 into the space 34. This operation takes place when the piston 11 is moving upwardly, the crank 14 having been moved through more than a one-quarter turn from the illustrated position, and high pressure steam in the space 34 acts against the exposed portion of the lower face of the piston portion 22 to exert a force driving the piston upwardly.

As above noted, the central axially extending member 42 of the valve 15 is preferably in the form of a hollow tube, providing communication between the space above the upper valve portion 37 and the space below the lower valve portion 40. Preferably, an additional groove 79 is provided at the lower end in axial alignment with a plurality of angularly spaced ports 80 in the sleeve 43 with a passage 81 extending from the groove 79 to the end of a second exhaust pipe 82. The exhaust pipes 72 and 82 may, if desired, be connected to a common exhaust pipe through a suitable "T" fitting.

As also mentioned previously, the space 33 is preferably vented to the exhaust for removal of steam passing the separator structure 28 and any condensed steam, as well as to provide a "breather" action promoting free movement about the piston. For this purpose, a port or passage 85 is provided in the wall of the cylinder body 25 just below the separator structure 28 and it communicates with one end of a passage formed by grooves 86 and 87 in the facing surfaces of the cylinder body 25 and the valve body 45. The passage so formed extends axially parallel to the cylinder and valve axes to an opposite end which communicates with the groove 79 and hence with the passage 81 extending to the exhaust pipe 82. Thus when the piston 11 is moved upwardly, any steam or condensation in the space 33 may flow through the port or passage 85, through the passage formed by grooves 86 and 87 and thence through the groove 79 and passage 81 to the exhaust pipe 82. When the piston is moving downwardly, the flow can be in the reverse direction under the appropriate conditions, preventing the establishment of a negative or vacuum pressure in the space 33, and thus providing a "breather" action to prevent any interference with proper movement of the piston 11.

The separator structure 28 comprises a sealing ring 91 engaging the outer surface of the intermediate portion 23 of the piston and a spacer ring 22 disposed radially outside the sealing ring 91 in concentric relation thereto, the rings 91 and 92 being sandwiched between a pair of support rings 93 and 94. The spacer ring 92 has a thickness slightly greater than that of the sealing ring 91 so that the sealing ring 91 can float to a limited extent for providing an optimum sealing action.

Important features relate to the construction of the piston 11. A member 96 is provided including a tubular body portion 97 and including an integral radially outwardly projecting annular portion 98 which has an outwardly facing groove 99 receiving a sealing or packing ring 100 engaged with the cylindrical inner surface 26 of the body 25. The portion 98 together with the ring 100 thus forms the end portion 21 of the piston 11.

A second member 102 is provided having an annular groove 103 which receives a sealing ring 104, to thereby form the opposite end portion 22 of the piston 11. A sleeve 106 surrounds the tubular body portion 97 to form the intermediate portion 23 of the piston. Preferably, as shown, annular recesses are provided in the upper and lower faces of the portion 98 of member 96 and the member 102, to receive the lower and upper ends of the sleeve 106.

To hold the parts in assembly, an eye-bolt 108 provided having an eye portion 109 which receives cross pin 110 the opposite ends of which extend int diametrically opposed openings 111 and 112 in th body portion 97 of the member 96. The bolt 108 has shank portion 114 extending through a central openin in the member 102, a nut 115 being threaded on th upper end of the shank portion 114.

A cylindrical wrist pin 118 is provided having oppo site ends in diametrically opposed openings in the bod portion 97 of the member 96. The connecting rod 13 in three parts, a main part 120 and end parts 121 an 122 bolted to the main part 120, the ends of the mai part 120 and the facing portions of the end parts 12 and 122 together providing internal cylindrical surface for bearing engagement with the outer cylindrical su face of the wrist pin 118 and the outer cylindrical su face of a crank portion 123 of the crankshaft 14.

Suitable bearings, not shown, are provided for jou nalling the crankshaft 14 and the camshaft 19 for rota tion about their respective axes, in fixed relation to th cylinder and valve bodies 25 and 45. Balancing weight 125 and 126 are carried by the crankshaft 14 and th camshaft 19.

It will be understood that while only one engine cylin der is illustrated, the engine may preferably include on or more additional cylinders and that a suitable lubri cating system is provided for lubricating the bearing including, for example, a crankcase and an oil pump fo providing pressure lubrication.

The construction of the piston 11 as illustrated an described facilitates assembly of the engine. The wris pin 118 may first be inserted into the body portion 9 of member 96 with the end of the connecting rod 1 being then connected by bolting part 121 to part 120 Then, with the cross pin 110 in place and the eye-bol 108 thereon, the sleeve 106 is installed on the bod portion 97 of the member 96 and the separator struc ture 28 is then inserted around the sleeve 106. Then th member 102 is installed with the shank portion 114 o bolt 108 extending therethrough, the nut 115 bein then threaded on the shank portion 114 and tightene to secure the parts in assembly. The opposite end of th connecting rod may then be secured to the crankshaf 14 by bolting part 122 to part 120.

It is noted that the curved passages 65 and 77 ar formed by providing aligned openings in the parts including the cylinder and valve bodies 25 and 45, th sleeve 30, the ring 94 and the portion 32 of the en plate 31. The curved configuration of the passages 6 and 77 is important in that the inner ends of the pas sages are in generally facing relation to the lower an upper faces of the piston portion 22 to insure entry an exit of steam in the proper direction, particularly at th ends of the limits of travel of the piston.

The direction connection of the piston to the crank shaft through a connecting rod is highly desirable i minimizing the overall size of the engine. At the sam time, due to the construction of the piston, with th intermediate reduced diameter portion 23 and the co operation with the separator structure 28 and also du to the controlled flow of steam in the manner as de scribed, positive force is applied to the piston bot when it is travelling down and when it is travelling up It is further noted that due to the fact that the hig pressure steam acts against the reduced area of th exposed face of the portion 22 while the intermediat pressure steam in the space 35 acts against the large area upper face of the portion 22 of the piston, the forces acting on the piston in the up and down strokes are more nearly equalized and the torque applied to the crankshaft is more uniform. With an additional piston and cylinder operated in the proper phase relation, it is possible to obtain a very smooth application of torque.

The construction of the valve is also important, particularly with respect to the provision of the annular grooves and angularly spaced ports and the provision of the hollow member 42 for communication between opposite ends. The result is that forces acting on the valve member 15 are balanced minimizing friction and allowing actuation of the valve member with minimum applied forces.

It will be understood that modifications and variations may be effected without departing from the spirit and scope of the novel concepts of this invention.

I claim as my invention:

1. In a steam engine, cylinder means defining internal cylindrical surface means having a vertical axis, piston means reciprocably movable in said cylinder means, a crankshaft rotatable about a horizontal axis aligned with said vertical axis and below said piston means, a connecting rod having an upper end extending within and pivotally connected to said piston means and having a lower end pivotally connected to said crankshaft, said piston means including an upper end portion having external cylindrical surface means in sealing engagement with said internal cylindrical surface means and including a reduced diameter portion having an external cylindrical surface in concentric relation to said cylindrical surface means, annular means projecting inwardly from said cylinder means into sealing engagement with said external cylindrical surface of said reduced diameter portion, top wall means closing the upper end of said cylinder means, there being a first variable volume space between said annular means and said upper end portion of said piston means and a second variable volume space between said top wall means and said upper end portion of said piston means, a high pressure steam inlet, an exhaust steam outlet, and valve means operable in synchronized relation to rotation of said crankshaft between a first condition during upward movement of said piston means and a second condition during downward movement of said piston means, said valve means being operable in said first condition to introduce high pressure steam from said inlet to said first space and to permit flow from said second space to said outlet and being operable in said second condition to permit flow from said first space to said second space, said cylinder means including second internal cylindrical surface means along said vertical axis and below said annular means, said piston means including a lower end portion having external cylindrical surface means in sealing engagement with said second internal cylindrical surface means of said cylinder means, there being a third variable volume space between said second end portion of said piston means and said annular means.

2. In an engine as defined in claim 1, said valve means comprising a valve body, a valve member, means defining a valve chamber within said valve body for reciprocable movement of said valve member therewithin along a vertical axis in spaced parallel relation to said cylinder axis, and passage means providing communication between said first and second spaces and said inlet and outlet.

3. In an engine as defined in claim 2, said passage means including first passage means between said first space and said valve chamber in a first horizontal plane, second passage means between said second space and said valve chamber in a second horizontal plane, third passage means between said inlet and said valve chamber in a third horizontal plane, fourth passage means between said outlet and said valve chamber in a fourth horizontal plane, and fifth passage means between points in said valve chamber in fifth and sixth horizontal planes, said third and fourth planes being offset in one direction from said first and second planes, said fifth and sixth planes being offset in an opposite direction from said first and second planes, and a plurality of valve portions on said valve member operable in said first condition to allow flow between said first and second planes and said third and fourth planes and in said second condition to allow flow between said first and second planes and said fifth and sixth planes.

4. In an engine as defined in claim 3, said valve body having a vertical bore therein with annular grooves in said bore in said horizontal planes in communication with said passages, and said valve chamber means comprising a sleeve in said bore having a plurality of sets of angularly spaced ports in said planes.

5. In an engine as defined in claim 2, said passage means including first passage means extending to said first space and second passage means extending to said second space, said first and second passage means having curved configurations and including terminal end portions in said annular means and said top wall means directed upwardly and downwardly toward the lower and upper surfaces of said upper end portion of said piston means.

6. In an engine as defined in claim 2, said valve member comprising a central vertically extending hollow portion and a plurality of annular valve portions in vertically spaced relation on said hollow portion, said hollow portion providing communication between opposite ends of said valve chamber and said outlet being in communication with one end of said valve chamber.

7. In an engine as defined in claim 6, a second exhaust steam outlet communicating with the opposite end of said valve chamber.

8. In an engine as defined in claim 1, breather means establishing communication between said third space and said outlet.

9. In an engine as defined in claim 1, said piston means comprising a sleeve defining said reduced diameter portion and arranged to be inserted within said annular means, a first member having a generally cylindrical portion within said sleeve, annular means engaging the lower end of said sleeve and projecting outwardly from the lower end of said cylindrical portion of said first member to define said lower end portion of said piston, a second member engaged with the upper end of said sleeve over the upper end of said generally cylindrical portion of said first member and defining said upper end portion of said piston means, and securing means for securing said second member to said first member after insertion of said sleeve within said annular means of said cylinder means.

10. In an engine as defined in claim 9, said securing means comprising a cross pin, an eye-bolt including an eye portion receiving said cross pin, a shank portion extending upwardly through said second member and a nut threaded on the upper end of said shank portion, said cylindrical portion of said first member having aligned diametrically opposed openings receiving opposite ends of said cross pin within said sleeve.

11. In an engine as defined in claim 9, a wrist pin, said cylindrical portion of said first member having aligned diametrically opposite openings receiving opposi ends of said wrist pin within said sleeve, and mea journalling the upper end of said connecting rod c said wrist pin.

* * * * *

UNITED STATES PATENT OFFICE
CERTIFICATE OF CORRECTION

PATENT NO. : 3,995,531

DATED : December 7, 1976

INVENTOR(S) : Joseph Zibrun

It is certified that error appears in the above-identified patent and that said Letters Patent are hereby corrected as shown below:

Delete Figures 1 thru 5 and substitute the attached Figures 1 & 2 therefore.

Signed and Sealed this

Twenty-second Day of March 1977

[SEAL]

*Attest:*

RUTH C. MASON
*Attesting Officer*

C. MARSHALL DANN
*Commissioner of Patents and Trademarks*